US010115550B2

(12) United States Patent
Schertler et al.

(10) Patent No.: US 10,115,550 B2
(45) Date of Patent: Oct. 30, 2018

(54) ELECTRICAL SWITCHING DEVICE WITH A LOW SWITCHING NOISE

(71) Applicant: TE Connectivity Germany GmbH, Bensheim (DE)

(72) Inventors: Katrin Schertler, Dallgow-Doberitz (DE); Andreas Hendler, Berlin (DE); Uwe Kramer, Schulzendorf (DE); Matthias Kroeker, Mittenwalde-Ragow (DE); Harry Koch, Berlin (DE); Bernd Rahn, Borgsdorf (DE); Gerd Marquardt, Berlin (DE)

(73) Assignee: TE Connectivity Germany GmbH, Bensheim (DE)

( * ) Notice: Subject to any disclaimer, the term of this patent is extended or adjusted under 35 U.S.C. 154(b) by 87 days.

(21) Appl. No.: 15/010,006

(22) Filed: Jan. 29, 2016

(65) Prior Publication Data

US 2016/0225567 A1 Aug. 4, 2016

(30) Foreign Application Priority Data

Jan. 30, 2015 (DE) ..... 10 2015 201 703

(51) Int. Cl.

| | |
|---|---|
| ***H01H 50/56*** | (2006.01) |
| ***H01H 50/30*** | (2006.01) |
| ***H01H 50/58*** | (2006.01) |
| ***H01H 50/18*** | (2006.01) |
| *H01H 50/06* | (2006.01) |
| *H01H 50/28* | (2006.01) |

(52) U.S. Cl.

CPC ..... *H01H 50/56* (2013.01); *H01H 50/18* (2013.01); *H01H 50/30* (2013.01); *H01H 50/58* (2013.01); *H01H 50/06* (2013.01); *H01H 50/28* (2013.01)

(58) Field of Classification Search

CPC ..... H01F 7/14; H01H 50/54
USPC ..... 335/201, 78
See application file for complete search history.

(56) References Cited

U.S. PATENT DOCUMENTS 4,684,910 A * 8/1987 Dittmann ..... H01H 50/28 335/274
4,745,382 A * 5/1988 Dittmann ..... H01H 50/28 335/128
5,003,274 A * 3/1991 Chikira ..... H01H 1/18 335/128

(Continued)

FOREIGN PATENT DOCUMENTS

DE 10239289 A1 4/2003
WO 2004003953 A1 1/2004

OTHER PUBLICATIONS

European Search Report, dated Jun. 15, 2016, 8 pages.
European Patent Office communication, dated Mar. 6, 2018, 6 pages.

*Primary Examiner* — Alexander Talpalatski
(74) *Attorney, Agent, or Firm* — Barley Snyder

(57) ABSTRACT

An arrangement for an electrical switching device is disclosed. The arrangement for an electrical switching device comprises a contact spring and a component attached to the contact spring. The component has an edge running in an inclined manner with respect to a longitudinal direction of the contact spring. The component also has at least two switching state positions and a transition phase between the switching state positions, and abuts the contact spring along the edge in the transition phase.

21 Claims, 4 Drawing Sheets

(56) References Cited

U.S. PATENT DOCUMENTS

| | | | | | |
|---|---|---|---|---|---|
| 5,151,675 | A * | 9/1992 | Biehl | H01H 1/2075 | 335/128 |
| 5,329,265 | A * | 7/1994 | Guidi | H01H 50/305 | 335/78 |
| 5,689,222 | A * | 11/1997 | Schneider | H01H 50/36 | 335/128 |
| 5,864,269 | A | 1/1999 | Grueber et al. | | |
| 5,900,791 | A | 5/1999 | Hoffmann et al. | | |
| 6,225,880 | B1 * | 5/2001 | Kern | H01H 49/00 | 335/159 |
| 6,266,867 | B1 * | 7/2001 | Kern | H01H 49/00 | 29/602.1 |
| 9,007,156 | B2 * | 4/2015 | Hiraiwa | H01H 9/443 | 335/78 |
| 2014/0159837 | A1 * | 6/2014 | Hiraiwa | H01H 9/443 | 335/201 |

* cited by examiner

ELECTRICAL SWITCHING DEVICE WITH A LOW SWITCHING NOISE

CROSS-REFERENCE TO RELATED APPLICATIONS

This application claims the benefit of the filing date under 35 U.S.C. § 119 (a)-(d) of German Patent Application No. 102015201703.6, filed Jan. 30, 2015.

FIELD OF THE INVENTION

The invention relates to an electrical switching device, and more particularly, to an electrical switching device with a contact spring.

BACKGROUND

A known electrical switching device has at least one contact spring and at least two switching states. Such arrangements are known in hinged-armature relays, for example.

A disadvantage of such arrangements is the very loud noises generated when switching from one switching state into the other.

SUMMARY

An object of the invention, among others, is to provide an arrangement for an electrical switching device that switches with lower noise. The disclosed arrangement for an electrical switching device comprises a contact spring and a component attached to the contact spring. The component has an edge running in an inclined manner with respect to a longitudinal direction of the contact spring. The component also has at least two switching state positions and a transition phase between the switching state positions, and abuts the contact spring along the edge in the transition phase.

BRIEF DESCRIPTION OF THE DRAWINGS

The invention will now be described by way of example with reference to the accompanying figures, of which.

DETAILED DESCRIPTION OF EMBODIMENT(S)

Figure 2:
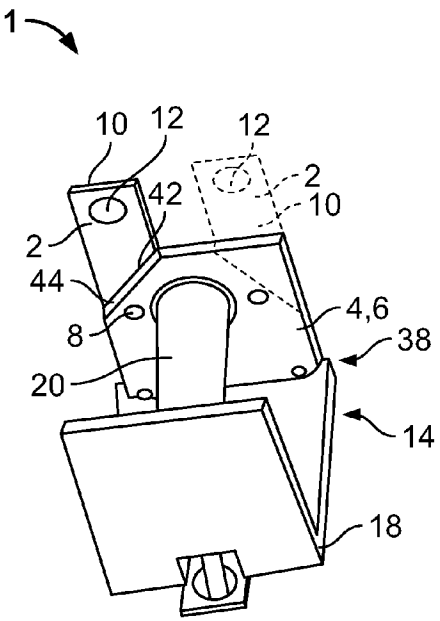
FIG. 2 is another perspective view of the embodiment of FIG. 1.

The invention is explained in greater detail below with reference to embodiments of an arrangement for an electrical switching device. This invention may, however, be embodied in many different forms and should not be construed as limited to the embodiments set forth herein; rather, these embodiments are provided so that this disclosure will be thorough and complete and still fully convey the scope of the invention to those skilled in the art.

The arrangement 1 for an electrical switching device is explained with reference to FIGS. 1-4. The arrangement 1 includes a contact spring 2, a spring member 3, a component 4, and a magnet system 14. The major components of the invention will now be described in greater detail.

The contact spring 2 can be part of the fork-shaped spring member 3 and be formed by a leg 10 of the spring member 3, which leg 10 of the spring member 3 extends away from the at least one fastening location 8. The contact spring 3, optionally at its free end, is provided with at least one contacting location 12. FIG. 2 depicts as an alternative, as a dashed line, the fact that the second leg 10 can also form a contact spring 2 equipped with a contacting location 12. If such a second contact spring is present, the following comments made with reference to one contact spring correspondingly apply to the second contact spring. A restoring spring 32 is also integrated into the spring member 3, and may be positioned on an end of the spring member 3 opposite the contact spring 2. The restoring spring 32 may have a spring bulge 40.

The component 4 may be in the form of an armature 6. The component 4, as shown in FIG. 2, has an edge 42 which runs in an inclined manner to the longitudinal direction 46 of the contact spring 2. For example, the edge is formed by an end face 44 of the component 4, which end face 44 points towards the contacting location 12 of the contact spring 2. The incline 48 of the edge 42 can be generated by a continuously rectilinear course or a continuously bent or curved course; the edge can also be composed of individual inclined and/or curved sections.

The magnet system 14 has, for example, a coil 16 (only indicated by a dashed line in FIG. 3), a yoke arrangement 18 and/or a core pole 20. The armature 6 would be a part of such a magnet system.

The assembly of the arrangement 1 for an electrical switching device will now be described.

The contact spring 2 may be fastened to the component 4 via one or more fastening locations 8, for example a clinching, a riveting or a weld spot. The component 4 and the at least one contact spring 2 are, in the relaxed, force-free state, flat, substantially plate or disc-shaped components which are situated approximately in planes which run parallel to one another. In the relaxed state, the contact spring 2 can abut the component 4, as can clearly be seen in particular in FIG. 3.

The restoring spring 32 may extend around an articulation location 38 of the component 4. It can be fastened to the magnet system 14, for example to the yoke arrangement 18. The spring bulge 40 may stick out from the component 4.

A switching process with low switching noise is possible with the arrangement 1. The arrangement 1 is particularly suitable for installation in a hinged-armature relay. A switching process is shown, by way of example, in FIG. 4.

The arrangement 1 can be transferred into at least two different switching states 22 and 24. In one switching state 24, the contact spring 2 is moved with respect to the other switching state 22. This movement can be caused by movement of the component 4, for example a tilting movement of the armature 6 triggered by the magnet system 14 can trigger a movement of the contact spring 2.

In the switching state 22, for example in the case of the armature 6 attracted to the front face 26 of the core pole 20, the contact spring 2 can be connected at its contacting location 12, in an electrically conductive manner, to a counter-contact 28. In order to press the counter-contact 28 and the contact spring 2 together in a sufficiently firm, and thus vibration-resistant, manner, the contact spring 2 may be resiliently deflected in the switching state 22. In the region above the fastening location 8, the contact spring 2 is spaced apart from the component 4 in the switching state 22.

Figure 4:
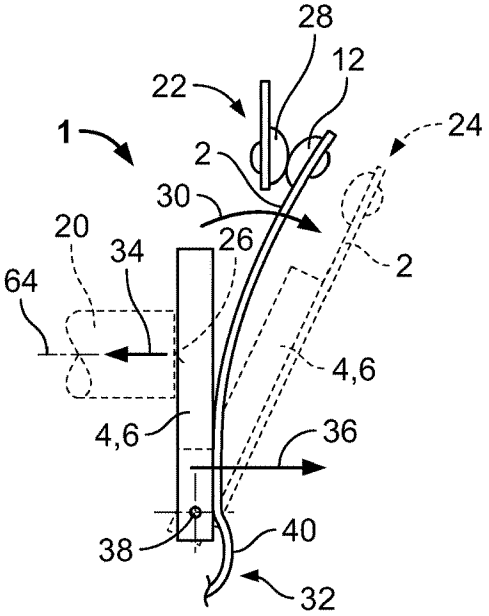
FIG. 4 is a side view of two switching states of the embodiment of FIG. 1.

If the component 4 begins to move towards the contact spring 2 when a switching process is initiated, there begins a transition phase which is depicted by the arrow 30 in FIG. 4 and which ends when the other switching state 24 is reached. Such a movement can, for example, be generated by the armature 6 dropping away from the core pole 20.

The switching process can be driven by a restoring spring 32. The restoring spring 32 can generate, for example, on the armature 6 a return force 36 which is counter to the drive force 34 exerted by the magnet system 14. In the depicted embodiment, the return force 36 is pressing the component 4 or armature 6 from one switching state 22 into the other switching state 24. In this case, the return force 36 may be smaller than the drive force 34, so that the switchable drive force 34 can overcome the return force 36 always present and can convey the component 4 from the other switching state 24 back into the first switching state 22. The switching process can also be driven by the magnet system 14.

The articulation location 38 is used for the pivotable bearing of the component 4 or armature 6. For example, a simple knife-edge bearing, which is supported on the yoke arrangement 18, can be used.

In the switching state 24, the counter-contact 28 and the contact spring 2 are released from one another. The contact spring 2 is substantially force-free and can abut the component 4 or is pressed against the component 4 by internal stresses.

Since, in the switching state 22, the contact spring 2 and the component 4 are spaced apart from one another and, in the other switching state 24, abut one another, a mechanical contacting of contact spring 2 and armature 6 takes place during the transition phase 30 between the two switching states 22 and 24. Since the switching process should take place as quickly as possible, the mechanical contacting occurs extremely briefly so that the contact spring 2 and the component 4 strike or smack against one another. In the case of an armature 6 as a component 4, for example when the armature 6 impacts, a proportion of the kinetic energy of the component 4 is intended to be transferred onto the contact spring 2, in order to rapidly accelerate said contact spring.

Figure 6:
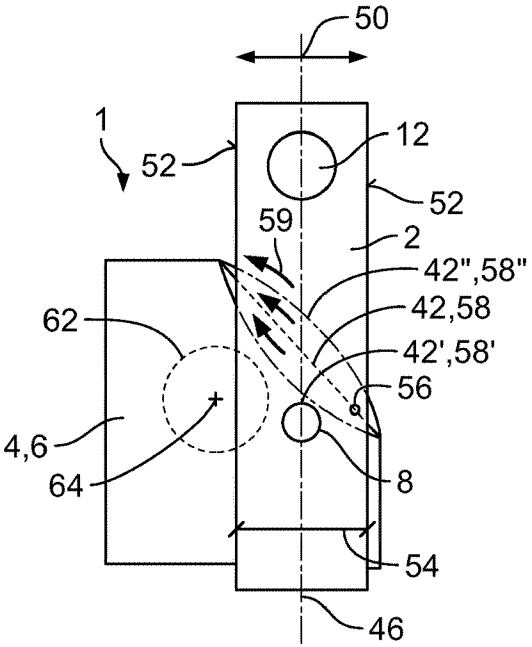
FIG. 6 is a front view of the embodiment of FIG. 5.
Figure 5:
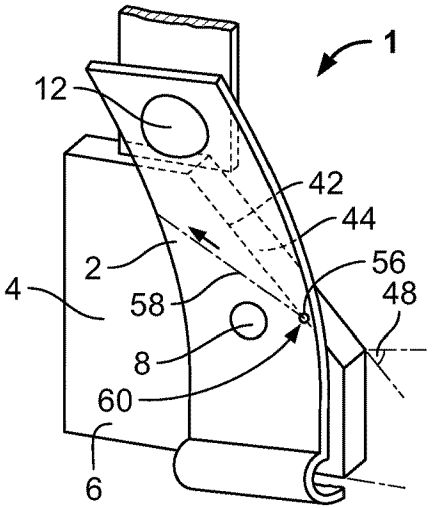
FIG. 5 is a perspective view of another embodiment of an arrangement for an electrical switching device according to the invention.

In order to reduce the development of noise when component 4 and contact spring 2 abut one another, according to the invention there takes place between the component 4 and the contact spring 2 a type of rolling movement which is explained hereafter with reference to FIGS. 4 to 6.

To minimize noise, the edge 42 extends in a width direction 50 of the contact spring 2 which runs transverse to the longitudinal direction 46, until beneath the fastening location 8. The regions of the edge 42 alongside or beneath the fastening location 8 respectively are situated in particular opposite a lateral rim 52 of the contact spring 2. The region of the edge 42 alongside or beneath the fastening location 8 may be further distant from the core pole 20 than a region of the edge 42 which is located nearer the contacting location 12.

In one switching state 22, the contact spring 2 is pressed against the counter-contact 28 and in this case is resiliently deflected so that it curves away from the component 4. As it becomes more distant from the fastening location 8, it is further spaced apart from the component 4. If the component 4 now moves towards the contact spring 2 in the transition phase 30, for example by the armature dropping off, the contact spring 2, starting from the fastening location 8, is applied to the component 4 until the edge 42 is reached. As a result of the incline 48 of the edge 42, those sections of the contact spring 2 which are opposite a region of the edge 42 which is closer to the fastening location 8 in the longitudinal direction 46 reach the edge 42 sooner than those sections of the contact spring which are opposite a region of the edge 42 which, in the longitudinal direction, is spaced further apart from the fastening location 8.

As soon as the edge 42 is reached, the contact spring 2 and the component 4 can no longer strike against one another over the entire width 54. In addition, the supporting, asymmetrically in the width direction 50, of the contact spring 2 on the edge 42 leads to a twisting of the spring 2 about the longitudinal direction 46. The smacking of the contact spring 2 and the component 4 in the conventional arrangements 1 is converted into a type of rolling movement of the contact spring 2 and the component 4, which means that the switching process is considerably quieter than in conventional arrangements.

The switching noise is reduced once again if the edge 42 extends in the width direction of the contact spring 2 as far as alongside the fastening location 8 or in the longitudinal direction 46 even as far as beneath the fastening location 8. In these cases, the rolling movement begins immediately upon leaving the switching state 22. In order to increase the twisting of the contact spring, as already stated above, the region of the edge 42 at the greatest distance from the fastening location 8 in the longitudinal direction 46 and/or the region of the edge 42 next to the fastening location 8 in the longitudinal direction 46 is intended to be opposite a lateral rim 52 of the contact spring 2.

In the course of the transition phase, an abutting location 56 on which the contact spring 2 is supported on the component 4 is formed at the region of the edge 42 closest to the fastening location 8 in the longitudinal direction 46. During the rolling movement between the contact spring 2 and the component 4, the abutting location 56 at which the contact spring 3 in each case comes into contact with the component 4 moves along the edge 42 via the contact spring 2.

The abutting location 56 migrates in width direction 50 over the entire width 54 of the contact spring 2 so that, at the end of the transition phase, the contact spring 2 abuts the component 4 over its full width. The abutting location 56 constantly moves in the course of the transition phase over the contact spring 2 and in particular migrates along a line 58. The form of the line is determined by the course of the edge 42. This is depicted, by way of example, in FIG. 6. If an edge 42 is in a straight line, line 58 is also straight. If the edge 42 runs at an acute angle to the longitudinal direction 46, the movement of the abutting location 56 in the longitudinal direction of the contact spring 2 is increased. If the edge 42' is curved concavely, there arises, as shown by the curved line 58', an abutting location 56 which migrates increasingly in longitudinal direction 46 in accordance with the course of the transition phase 30. In contrast, in the case of a convexly curved edge 42", the abutting location 56 firstly migrates in an increased manner in the longitudinal direction 46 and then in an increased manner in the width direction, as line 58" shows.

As can be seen from arrow 59 in FIG. 6, the abutting location 56 migrates in the course of the transition phase 30 from a starting position 60 which can be located in particular at a lateral rim 52 of the contact spring 2, close to the fastening location 8 in the direction towards the contact location 12. Regardless of this, the abutting location 56 can, in the course of the transition phase 30, migrate in the direction of the core pole 20 from a side of the contact spring 2 which points away from the core pole 20.

The abutting location 56, in the course of the transition phase, remains constantly outside of a projection 62 of the front face 26 in the longitudinal direction 64 of the core pole 20 onto the component 4 or contact spring 2. The edge 42 is also located outside of the projection 62.

Figure 7:
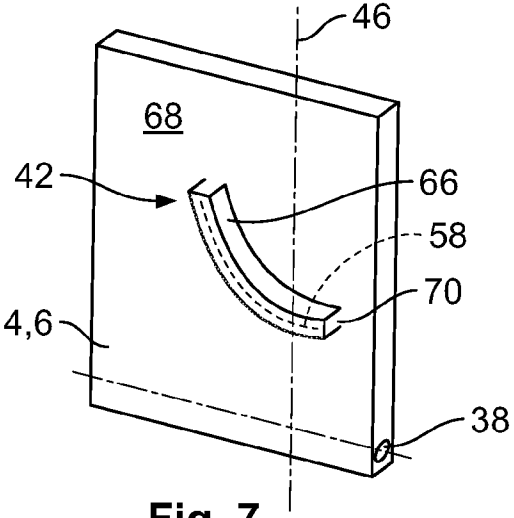
FIG. 7 is a perspective view of another embodiment of an arrangement for an electrical switching device according to the invention.

According to another embodiment, the edge 42 can be formed by a protrusion 66 of the component 4. Such an embodiment is shown by FIG. 7, in which, for ease of understanding, only the component 4 is shown, without further constituent parts of the arrangement 1. The protrusion 66 may protrude in the direction of the contact spring 2 from the surface 68, facing the contact spring 2, of the component 4. It can be located within the surface 68 and does not particularly have to be located at the end face 44. However, the protrusion 66 can also be formed directly on the inclined end face 44 and form the edge of the end face 44. The protrusion 66 can be formed as a rib 70. The edge 42 is depicted curved in FIG. 7 merely by way of example and may also have a different course inclined relative to the longitudinal direction.

Figure 8:
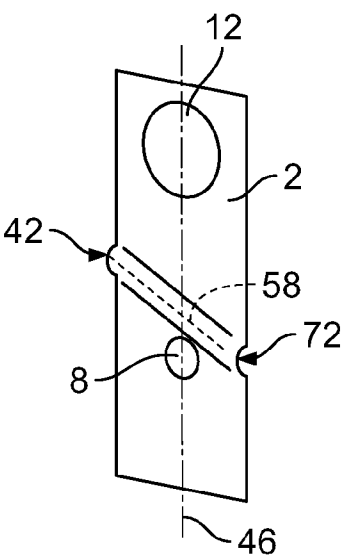
FIG. 8 is a perspective view of another embodiment of an arrangement for an electrical switching device according to the invention.

The edge 42 can also be formed by a protrusion 66 at the contact spring 2, for example by a bulge, a bead or a seam 72, which runs in an inclined manner relative to the longitudinal direction 46 of the contact spring. This is shown in FIG. 8. In the arrangement 1, the protrusion 66 protrudes in the direction of the component 4. The edge 42 of FIG. 8 is rectilinear only for illustration purposes. A different course of the edge 42 is possible here too.

Irrespective of whether the protrusion 66 is located at the component 4 or at the contact spring 2, it may run continuously over at least the entire width 54 of the contact spring 2. The same applies to the edge 42.

The advantageous effect of the inclined edge is not restricted to the sequence of the switching states in FIGS. 1 to 6. The arrangement can, for example, have more than two switching states, as would be the case in a "bistable relay".

Figure 3:
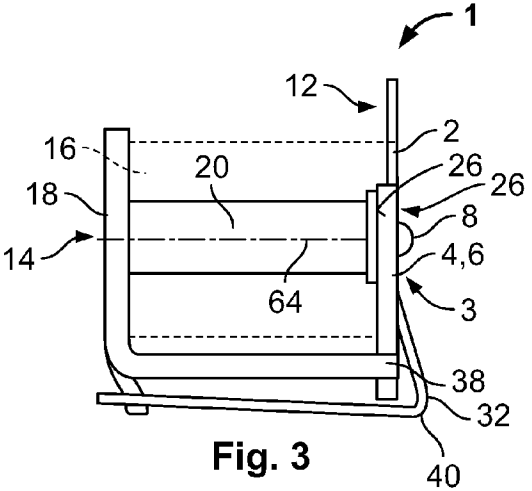
FIG. 3 is a side view of the embodiment of FIG. 1.
Figure 1:
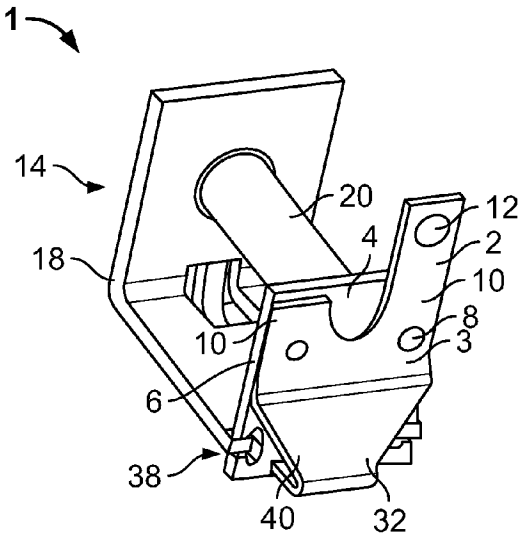
FIG. 1 is a perspective view of an embodiment of an arrangement for an electrical switching device according to the invention.
Figure 9:
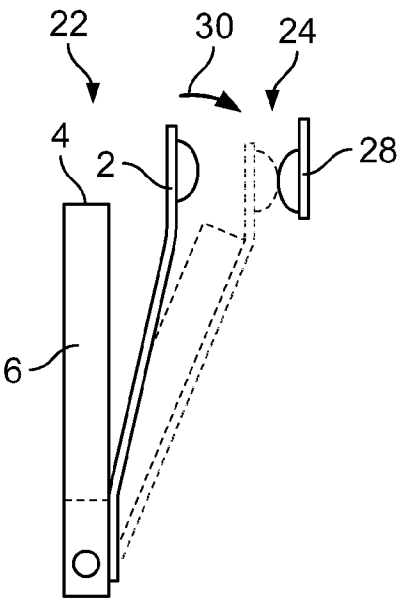
FIG. 9 is a side view of another embodiment of an arrangement for an electrical switching device according to the invention.

Furthermore, contacting between the contacting location 12 and the counter-contact 28 cannot, as depicted in FIG. 3, take place when the armature 6 is attracted, but rather also when the armature 6 has fallen. This is schematically depicted in FIG. 9. Of importance here is only that the contact spring 2 and the component 4 hit one another during the switching process. Finally, the reduction of the development of noise by the inclined edge is independent of whether one switching state 22 corresponds to a closing and the other switching state 24 corresponds to an opening of contacts or, as in FIG. 9, vice versa.

Figure 10:
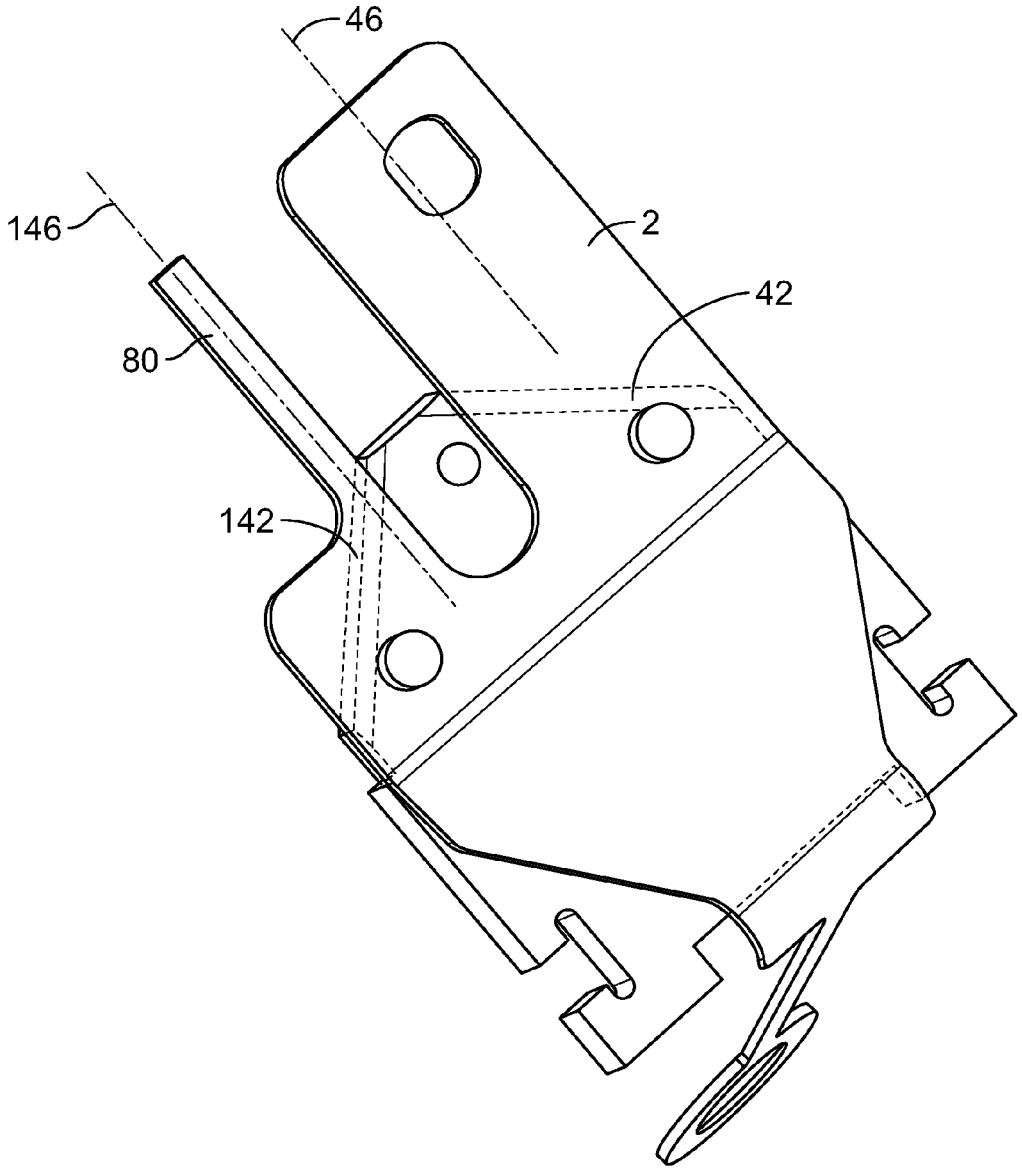
FIG. 10 is a perspective view of another embodiment of an arrangement for an electrical switching device according to the invention.

In the embodiment in FIG. 10, an edge 42 which, in the region in which the armature 6 abuts the contact spring 2, again runs in an inclined manner with respect to the longitudinal direction 46 of the contact spring 2. In addition, an edge 142 which, in the region in which the armature 6 abuts the counter-spring 80, also runs in an inclined manner with respect to the longitudinal direction 146 of the counter-spring 80. According to the same principle, a noise development can therefore also be reduced at the counter-spring 80. In this case, the longitudinal directions 46 and 146, respectively, of the contact spring 2 and the counter-spring 80 run parallel. The counter-spring 80 can serve to produce a counter-force which counteracts a return force of the restoring spring 32 so that no hard strike is necessary.

Advantageously, with an edge running in an oblique manner, the switching noise of a switching appliance has been able to be reduced by 2 dB (A) compared with a switching appliance with a straight edge. To measure noise, the switching arrangement was inserted in a low-reflection closed container with sound-absorbent walls and a reflecting floor in an automobile plug socket which was placed on a resiliently suspended surface. The switching appliance was switched on energised with 13.5 V and was switched on again without coil suppression. The switching noise was measured with a microphone at a distance of 1 m from the switching appliance within the container and evaluated via the A-filter.

What is claimed is:

1. An arrangement for an electrical switching device, comprising:

a contact spring; and a component attached to the contact spring at a fastening location and having an edge extending in an inclined manner with respect to a longitudinal direction of the contact spring, the component having at least two switching state positions and a transition phase between the switching state positions, the component movable with respect to the contact spring between the two switching state positions and abutting the contact spring along the edge in the transition phase, the edge abutting the contact spring at an abutting location positioned at an intersection of the edge with a line extending through the fastening location orthogonal to the longitudinal direction.

2. The arrangement for an electrical switching device of claim 1, wherein the edge extends over a width of the contact spring.

3. The arrangement for an electrical switching device of claim 2, wherein, in one switching state position, the contact spring abuts the edge over a width of the contact spring.

4. The arrangement for an electrical switching device of claim 1, wherein the edge extends in a width direction of the contact spring at least up to a point aligned with the fastening location.

5. The arrangement for an electrical switching device of claim 1, wherein the edge is positioned on an end face of the component.

6. The arrangement for an electrical switching device of claim 5, wherein the edge faces a contacting location of the contact spring.

7. The arrangement for an electrical switching device of claim 1, wherein the abutting location moves in a longitudinal direction and/or a width direction of the contact spring in the course of the transition phase.

8. The arrangement for an electrical switching device of claim 7, wherein the abutting location moves away from the fastening location in the course of the transition phase.

9. The arrangement for an electrical switching device of claim 7, wherein the abutting location moves along a continuous line over the contact spring in the course of the transition phase.

10. The arrangement for an electrical switching device of claim 9, further comprising a core pole having a front face.

11. The arrangement for an electrical switching device of claim 10, wherein a projection of the front face in a longitudinal direction of the core pole extends onto the component.

12. The arrangement for an electrical switching device of claim 11, wherein the abutting location remains outside of the projection.

13. The arrangement for an electrical switching device of claim 1, wherein the component is an armature.

14. The arrangement for an electrical switching device of claim 13, wherein the contact spring forms a restoring spring of the armature.

15. The arrangement for an electrical switching device of claim 14, wherein the restoring spring has a bulge.

16. The arrangement for an electrical switching device of claim 15, further comprising a magnet system.

17. The arrangement for an electrical switching device of claim 16, wherein the contact spring is arranged externally from the magnet system.

18. The arrangement for an electrical switching device of claim 1, wherein, in one of the switching state positions, the contact spring is spaced apart from the edge.

19. The arrangement for an electrical switching device of claim 1, wherein, in one of the switching state positions, a distance between the edge and the contact spring varies along the length of the edge.

20. The arrangement for an electrical switching device of claim 1, wherein the edge is curved.

21. The arrangement for an electrical switching device of claim 1, wherein the edge is formed by a protrusion extending from a surface of the component.

* * * * *